US008246036B2

(12) United States Patent
Sato et al.

(10) Patent No.: US 8,246,036 B2
(45) Date of Patent: Aug. 21, 2012

(54) PAPER SHEET HANDLING MACHINE

(75) Inventors: Tomoyasu Sato, Tokyo-To (JP); Toshihiko Suzuki, Tokyo-To (JP); Fumiaki Koga, Tokyo-To (JP); Manabu Hirano, Saitama (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 250 days.

(21) Appl. No.: 12/733,319

(22) PCT Filed: Aug. 30, 2007

(86) PCT No.: PCT/JP2007/066915

§ 371 (c)(1),
(2), (4) Date: Feb. 23, 2010

(87) PCT Pub. No.: WO2009/028071

PCT Pub. Date: Mar. 5, 2009

(65) Prior Publication Data

US 2010/0244356 A1 Sep. 30, 2010

(51) Int. Cl.
*B65H 5/22* (2006.01)

(52) U.S. Cl. ..... 271/3.14; 271/298

(58) Field of Classification Search ..... 271/3.14, 271/298; 209/534

See application file for complete search history.

(56) References Cited

U.S. PATENT DOCUMENTS

| | | | | |
|---|---|---|---|---|
| 5,626,822 | A | 5/1997 | Kadowaki et al. | 422/307 |
| 6,311,819 | B1 | 11/2001 | Stromme et al. | 194/207 |
| 2006/0001209 | A1 | 1/2006 | Takagi | |

FOREIGN PATENT DOCUMENTS

| | | | |
|---|---|---|---|
| EP | 1 035 521 | A1 | 9/2000 |
| EP | 1 643 462 | A2 | 4/2006 |
| EP | 1 816 613 | A1 | 8/2007 |
| GB | 2 023 106 | A | 12/1979 |
| JP | 58-165184 | | 9/1983 |
| JP | 58-165184 | A | 9/1983 |
| JP | 63-101244 | | 5/1988 |
| JP | 2003-296783 | | 10/2003 |
| JP | 2007-156962 | | 6/2007 |

OTHER PUBLICATIONS

Chinese Patent Application No. 200780100446.X—Office Action issued on Aug. 11, 2011 (4 pages) with English translation (5 pages).
European Search Report (dated Nov. 12, 2010—7 pages).

*Primary Examiner* — David H Bollinger

(74) *Attorney, Agent, or Firm* — Renner, Kenner, Greive, Bobak, Taylor & Weber

(57) ABSTRACT

A paper sheet handling machine 1 comprises a casing 92 and at least two stacking units 30, 40 provided in the casing 92. Each stacking unit 30, 40 is configured to stack therein paper sheets respectively taken in the casing 92 by a take-in unit 10. From among the paper sheets transported by a transport unit 20, the paper sheets, each judged to be stored in the stacking unit 30 or 40 by a recognition unit 28, are diverted from the transport unit 20 and fed into the stacking unit 30 or 40, by each diverter 60, 62. A reject unit 50 is connected with the transport unit 20 on the downstream side of the diverters 60, 62. To the reject unit 50, the paper sheets that are not diverted from the transport unit 20 by the respective diverters 60, 62 are fed.

6 Claims, 3 Drawing Sheets

PAPER SHEET HANDLING MACHINE

FIELD OF THE INVENTION

The present invention relates to a paper sheet handling machine, which can take paper sheets therein, one by one, from the exterior, and then sort and store the paper sheets taken in the machine into a plurality of stacking units.

BACKGROUND OF THE INVENTION

In the past, a banknote handling machine, which can store therein banknotes deposited from a customer, while sorting them, for each denomination of money, has been known. In the banknote handling machine of this type, the banknotes are first received in a hopper upon a deposit operation for the banknotes, and then the banknotes received in the hopper are fed into the banknote handling machine, one by one, by a banknote feeding unit.

Thereafter, the banknotes fed in the banknote handling machine are first detected, respectively, by a recognition unit provided to a transport path, in regard to the fitness, authenticity, denomination, orientation, face/back, transported condition and the like. Then, the banknotes that cannot be recognized by the recognition unit (e.g., damaged unfit banknotes or the like) and/or banknotes that have been excluded from the banknotes to be stored in each stacking unit, because of their abnormal transported condition (e.g., an obliquely transported condition or the like) even after they have been recognized, will be fed to a reject unit provided in the banknote handling machine. From among the banknotes taken in the banknote handling machine, the banknotes judged to be fed to the reject unit by the recognition unit will be referred to as "rejected banknotes" below.

Meanwhile, the banknotes judged to be stored in the banknote handling machine by the recognition unit are sorted, for example, for each denomination thereof, based on each recognition result of the recognition unit, and then fed selectively to each stacking unit corresponding to the denomination. In this way, the banknotes received in the hopper of the banknote handling machine can be sorted for each denomination thereof and then stored in the banknote handling machine.

For instance, the banknote handling machine as described above is disclosed in JP2003-276875A.

DISCLOSURE OF THE INVENTION

In the above conventional banknote handling machine, a diverter (or diverters) is provided in a position downstream relative to the recognition unit, in the middle of the transport path running from the hopper toward each stacking unit. This diverter has a nail-like shape and serves to selectively divert the banknotes, each having been transported along the transport path, from the same. With such configuration, each banknote judged to be the rejected banknote by the recognition unit can be selectively diverted by the diverter from the transport path and then fed to the reject unit. Meanwhile, the banknote judged to be stored in the banknote handling machine by the recognition unit will be continuously transported along the transport path, without being diverted from the transport path by the diverter, and thus directly fed into each stacking unit. Namely, the diverter can serve to selectively divert each rejected banknote, such as the banknote under the abnormal transported condition (e.g., the obliquely transported condition or the like), damaged unfit banknote or the like, from the transport path toward the reject unit, in the middle of the transport path, thereby removing such a rejected banknote, in an early stage, from the transport path.

However, in such a banknote handling machine as described above, each rejected banknote may tend to be unduly curved along the nail-like shape of the diverter, immediately after the rejected banknote is diverted from the transport path by the diverter. For instance, in the banknote handling machine disclosed in the above JP2003-276875A, each rejected banknote is curved, by approximately 90°, immediately after being diverted by the diverter (or gate G1). In particular, when the banknotes under the abnormal transported condition and/or unfit banknotes are excessively curved, after being diverted from the transport path, a jam of the banknotes may be caused and even the operation of the banknote handling machine may be stopped. In order to recover the banknote handling machine from such a jam condition, it is necessary for an operator to open a casing of the banknote handling machine and remove the jammed banknotes by hand, thus taking unduly much time for recovering the banknote handling machine.

The present invention was made in light of the above problems. Therefore, it is an object of this invention to provide a new paper sheet handling machine, which can successfully prevent occurrence of the jam of the paper sheets, upon transporting the rejected paper sheets from a transport unit to a reject unit, thereby significantly enhancing the throughput.

A paper sheet handling machine according to the present invention comprises: a casing; a take-in unit configured to take paper sheets, one by one, into the casing from the exterior; a transport unit provided in the casing and configured to transport the paper sheets taken in by the take-in unit, successively, one by one, in the casing; a recognition unit provided to the transport unit and configured to recognize each paper sheet transported by the transport unit; at least two stacking units provided in the casing, each stacking unit being configured to stack therein the paper sheets taken in the casing by the take-in unit; a diverter provided to the transport unit on the downstream side of the recognition unit and configured to divert a portion of the paper sheets, from among the paper sheets transported by the transport unit, from the transport unit to feed the diverted paper sheets to each stacking unit; a reject unit connected with the transport unit on the downstream side of the diverter and configured to receive the paper sheets that are not diverted from the transport unit by the diverter; and a control unit configured to control the diverter to divert the paper sheets respectively judged to be stored in each stacking unit, from the transport unit to feed the diverted paper sheets to each stacking unit, based on each recognition result on the paper sheets provided from the recognition unit.

According to the above paper sheet handling machine, at least two stacking units, each adapted for stacking therein the paper sheets taken in the casing by the take-in unit, are provided in the casing. In addition, the paper sheets judged to be stored in the stacking units (e.g., the paper sheets judged to be the normal paper sheets), from among the paper sheets transported by the transport unit, can be diverted from the transport unit and selectively fed into the stacking units by the diverter. Thus, the paper sheets judged to be removed from the casing by the recognition unit (i.e., the rejected paper sheets), such as the paper sheets that cannot be recognized by the recognition unit (e.g., the damaged unfit paper sheets or the like) and/or paper sheets that have been excluded from the paper sheets to be stored in each stacking unit, because of their abnormal transported condition, even after they have been sufficiently recognized, from among the paper sheets taken in the casing by the take-in unit, will be transported by the transport unit, without being diverted from the transport unit by the diverter, and thus fed to the reject unit. Therefore, each rejected paper sheet can be fed to the reject unit, without being excessively curved in the vicinity of the diverter. Accordingly, the occurrence of the jam of the paper sheets, upon transporting the rejected paper sheets from the transport unit to the reject unit, can be successfully avoided, thereby significantly enhancing the throughput of the paper sheet handling machine.

In the paper sheet handling machine of the present invention, it is preferred that upon a feed operation of the paper sheets from the transport unit to the reject unit, each paper sheet can be released toward the reject unit from the transport unit, in substantially the same direction as the transport direction of the paper sheet transported by the transport unit immediately before being fed out to the reject unit. Thus, rejected paper sheets can be released from the transport unit toward the reject unit, without being curved. Therefore, the occurrence of the jam of the paper sheets can be prevented, more effectively, upon transporting each rejected paper sheet from the transport unit to the reject unit.

In the paper sheet handling machine of the present invention, it is preferred that the transport unit includes a first transport mechanism extending in a substantially horizontal direction, a second transport mechanism extending in the substantially horizontal direction below the first transport mechanism, and an intermediate transport mechanism provided between the first transport mechanism and the second transport mechanism, and that each paper sheet taken in the casing from the exterior by the take-in unit is transported by the first transport mechanism, intermediate transport mechanism and second transport mechanism, in this order. Thus, each paper sheet can be transported in the substantially horizontal direction, both by the first transport mechanism and by the second transport mechanism, without being unduly curved. Therefore, the occurrence of the jam of the paper sheets, especially the occurrence of the jam caused by the rejected paper sheets, on the transport unit can be prevented more securely. Further, the transport operation for transporting each paper sheet from an upper position to a lower position can successfully avoid transportation of the paper sheets in a direction against gravity. This can eliminate a need for always gripping (or grasping) each paper sheet, such as by using proper transport belts or the like, during the transport operation, unlike the case requiring to transport the paper sheet from the lower position to the upper position. Therefore, the occurrence of the jam in the transport unit can be further prevented. Preferably, the transport unit has a substantially U-like shape.

In the paper sheet handling machine of the present invention, it is preferred that the recognition unit is located in the first transport mechanism. Preferably, the diverter is located in the second transport mechanism, and the reject unit is connected with a downstream end of the second transport mechanism.

In the paper sheet handling machine of the present invention, it is preferred that the reject unit is provided below the take-in unit. Thus, each paper sheet can be transported from the upper position to the lower position, thereby preventing the paper sheet from being transported in the direction against gravity. This can eliminate a need for always gripping (or grasping) each paper sheet, such as by using proper transport belts or the like, during the transport operation, unlike the case requiring to transport the paper sheet from the lower position to the upper position. Therefore, the occurrence of the jam in the transport unit can be further prevented. Additionally, in the case in which the rejected paper sheets fed into the reject unit are required to be recognized again by the recognition unit, the position of the take-in unit located above the reject unit can facilitate the re-set of the rejected paper sheets into the paper sheet feeding unit.

In the paper sheet handling machine of the present invention, it is preferred that the control unit can further control the transport unit and diverter to feed the paper sheets present on the transport unit to the reject unit, when the paper sheets, each judged to be stacked in each stacking unit by the recognition unit, can no longer be fed to the stacking unit. For instance, the paper sheets, each judged to be the normal paper sheet by the recognition unit, may be jammed at, for example, an inlet of each stacking unit or the like, after being diverted from the transport unit by the diverter. Otherwise, the paper sheets may get delayed on the transport unit. In such cases, the paper sheets once taken in the casing can no longer be fed to each stacking unit. According to the above paper sheet handling machine, however, the control unit can drive the transport unit and diverter to feed the paper sheets remaining on the transport unit to the reject unit. This can eliminate the need to open the casing of the paper sheet handling machine and remove, by hand, the paper sheets remaining on the transport unit, thus saving the time for recovering the paper sheet handling machine.

In the paper sheet handling machine of the present invention, it is preferred that a detection unit configured to detect each paper sheet transported by the transport unit is provided to the transport unit, and that the control unit can further control the transport unit and diverter to feed the paper sheets present on the transport unit to the reject unit, when the detector detects stoppage of the paper sheets on the transport unit. For instance, such stoppage of the paper sheets on the transport unit may be caused by the jam of the paper sheets on the transport unit, and therefore these paper sheets can no longer be fed to each stacking unit. However, even in such a case, in order to remove the jam on the transport unit, the control unit can control the transport unit and diverter to feed the paper sheets remaining on the transport unit to the reject unit. Therefore, there is no need to open the casing of the paper sheet handling machine and remove, by hand, the jammed paper sheets. Thus, the time required for recovering the paper sheet handling machine can be significantly saved.

DETAILED DESCRIPTION OF THE INVENTION

Hereinafter, one embodiment of the present invention will be described with reference to the drawings. In this embodiment, one example, in which the paper sheet handling machine of this invention is used as the banknote handling machine adapted for handling the banknotes, is described. However, it should be noted that any other paper sheets (e.g., checks) than the banknotes can also be applied to the object handled by the paper sheet handling machine of this invention.

First of all, the general construction of the banknote handling machine of this embodiment will be described with reference to FIGS. 1 and 2.

Figure 1:
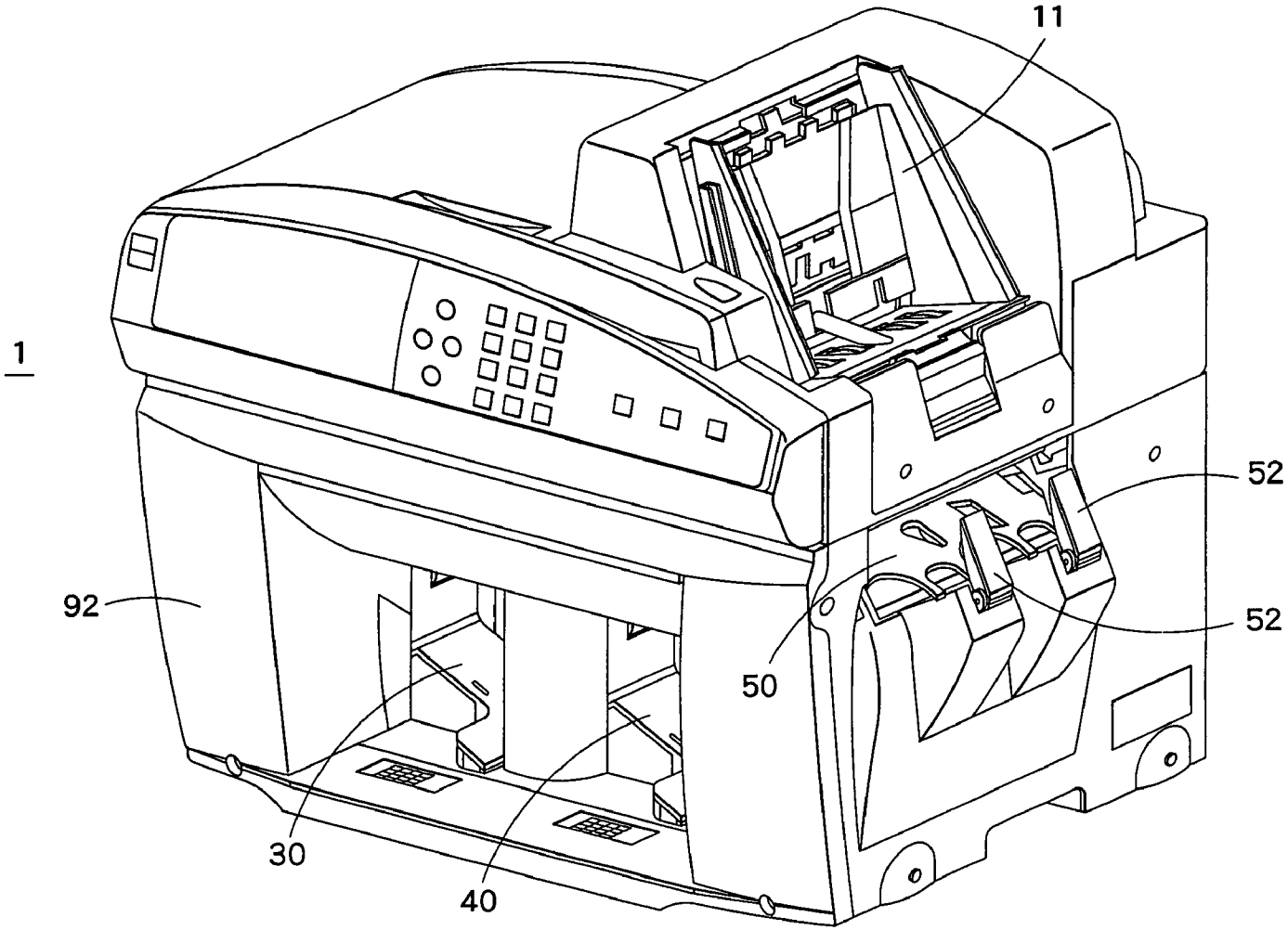
FIG. 1 is a perspective view showing external appearance of the banknote handling machine (or paper sheet handling machine) related to one embodiment of the present invention.

FIG. 1 is a perspective view showing external appearance of the banknote handling machine 1 of this embodiment. As shown in FIG. 1, the banknote handling machine 1 comprises a casing 92 having a substantially rectangular parallelepiped shape, a hopper 11, a first stacking unit (or first stacker) 30, a second stacking unit (or second stacker) 40 and a reject unit 50.

Figure 2:
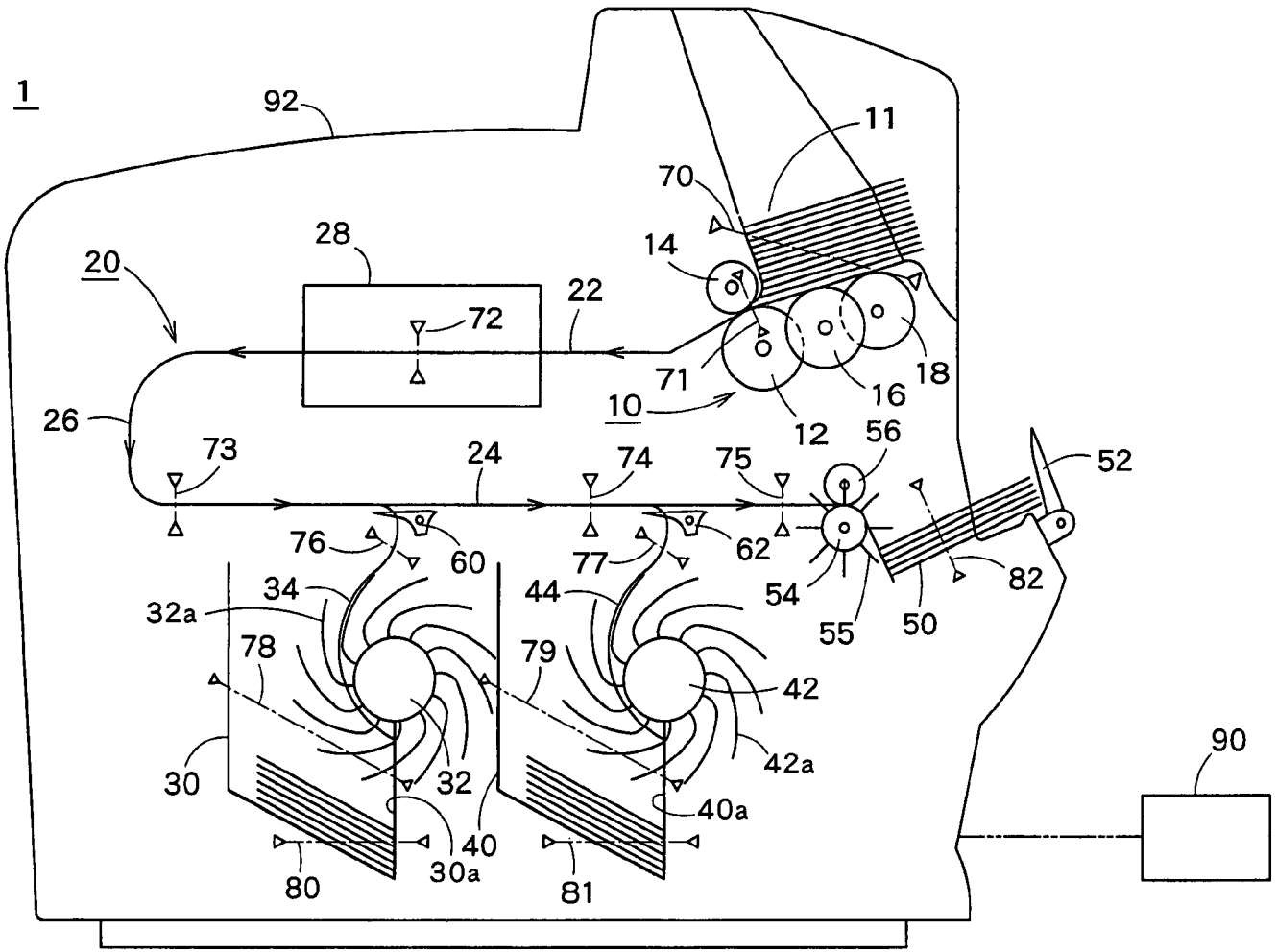
FIG. 2 is a diagram schematically showing the internal construction of the banknote handling machine shown in FIG. 1.

FIG. 2 is a diagram schematically showing the internal construction of the banknote handling machine 1 shown in FIG. 1, and particularly illustrates a transport system and a sensor system of the banknote handling machine 1. As shown in FIG. 2, a transport unit 20 is provided in the casing 92 of the banknote handling machine 1. In this case, the transport unit 20 can serve to successively transport the banknotes, one by one, in the casing 92. In addition, a control unit 90 is provided in the banknote handling machine 1, wherein this control unit 90 can serve to control the transport unit 22, diverters 60, 62 and the like.

Now, each component of the banknote handling machine 1 as constructed above will be described.

The hopper 11 is configured, such that a plurality of banknotes can be placed thereon, in a stacked condition, by the operator. In this case, the banknotes stored in the hopper 11 can be fed into the casing 92 of the banknote handling machine 1, one by one, by a banknote feeding unit (or take-in unit) 10.

The banknote feeding unit 10 includes a feed roller 12 adapted for feeding out each banknote, a gate roller (or reverse-rotation roller) 14 provided to be opposed to the feed roller 12 and configured to form a gate part between the feed roller 12 and this gate roller 14, and kicker rollers 16, 18, each adapted for kicking out the banknotes stored in the hopper 11 toward the feed roller 12. It is noted that while one example, in which the kicker rollers 16, 18 are arranged in two in a longitudinal direction, is shown in FIG. 2, the arrangement of the kicker rollers is not limited to this example. For instance, only one kicker roller (e.g., only the kicker roller 16) may be provided in the banknote handling machine 1. In either case, the banknotes taken in the casing 92 by the banknote feeding unit 10 can be transported by the transport unit 20.

The transport unit 20 includes an upper transport mechanism (i.e., first transport mechanism) 22 extending in the substantially horizontal direction, a lower transport mechanism (i.e., second transport mechanism) 24 extending in the substantially horizontal direction below the upper transport mechanism 22, and an intermediate transport mechanism 26 provided between the upper transport mechanism 22 and the lower transport mechanism 24. As shown in FIG. 2, the transport unit 20 composed of the respective transport mechanisms 22, 24, 26 has the substantially U-like shape on the whole. In this case, the banknotes taken in the casing 92 by the banknote feeding unit 10 can be transported, one by one, by the upper transport mechanism 22, intermediate transport mechanism 26 and lower transport mechanism 24, in this order. The upper transport mechanism 22, intermediate transport mechanism 26 and lower transport mechanism 24 are respectively composed of a combination of belt transport mechanisms. Specifically, each belt transport mechanism is composed of a pair of or three or more rollers and a belt, e.g., a rubber belt, provided over the rollers.

As shown in FIG. 2, a recognition unit 28 is provided to the upper transport mechanism 22 of the transport unit 20. The recognition unit 28 can serve to detect the fitness, authenticity, denomination, orientation, face/back, transported condition and the like of each banknote transported along the upper transport mechanism 22. As used herein, the term "detect the transported condition" means to detect "whether or not the banknotes are transported obliquely", "whether or not the banknotes are transported in an overlapped condition", "whether or not the banknotes are transported in a chained condition" or the like. Each recognition result of the recognition unit 28 can be transmitted to the control unit 90.

As shown in FIG. 2, two stacking units 30, 40 are further arranged, in parallel with each other, below the lower transport mechanism 24 of the transport unit 20. Each of the stacking units 30, 40 is configured to store therein, in the stacked condition, the banknotes that have been taken in the casing 92 and then judged to be normal ones by the recognition unit 28. As shown in FIG. 1, the banknotes stacked in each stacking unit 30, 40 can be optionally taken out by the operator.

Further, as shown in FIG. 2, each stacking unit 30, 40 is designed to store therein a batch of the banknotes in an inclined condition. With such inclined stacked condition of the banknotes, the batch of the banknotes stored in each stacking unit 30 or 40 can be taken out, with the position in a width direction of each banknote well arranged along each side wall 30*a*, 40*a* of the stacking units 30, 40.

Additionally, as shown in FIG. 2, two diverters 60, 62 are provided, in series, to the lower transport mechanism 24. Each diverter 60, 62 has, for example, a nail-like shape, and serves to divert a portion of the banknotes transported along the lower transport mechanism 24, from the lower transport mechanism 24 toward each diversion line 34, 44. The diversion lines 34, 44 are connected with the first and second stacking units 30, 40, respectively. Thus, the banknotes diverted from the lower transport mechanism 24 by the diverters 60, 62 can be fed into the first and second stacking units 30, 40, via the diversion lines 34, 44, respectively. It is noted that each diversion line 34, 44 is greatly curved in the vicinity of each diverter 60, 62, corresponding to the shape of the diverter 60 or 62.

In this embodiment, stacking wheels 32, 42 are provided to the first and second stacking units 30, 40, respectively. Each stacking wheel 32, 42 has a function for first receiving each banknote released from each diversion line 34, 44 toward each stacking unit 30, 40, in a space provided between each adjacent pair of vanes 32*a* or 42*a* of the wheel 32, 42, then rotating to allow the banknote to be stored in each stacking unit 30, 40, with the orientation and/or position of the banknote appropriately arranged.

At a downstream end of the lower transport mechanism 24, a release roller 54 for feeding out each banknote and an opposite roller 56 positioned to be opposed to the release roller 54 are provided. With this configuration, each banknote fed to the downstream end of the lower transport mechanism 24 can be released from a gap between the release roller 54 and the opposite roller 56. Thereafter, each banknote released by the two rollers 54, 56 can be stacked, one on another, in the reject unit 50, by a rotary rubber vane wheel 55 provided in the vicinity of the release roller 54 and adapted for beating the banknote. This configuration can facilitate the stacking operation for the rejected banknotes in the reject unit 50, because a rear edge of each banknote released from the gap between the release roller 54 and the opposite roller 56 can be properly beaten by the rotary rubber vane wheel 55 for beating the banknote.

Further, as shown in FIGS. 1 and 2, a stopper 52 is provided to the reject unit 50. This stopper 52 can serve to prevent each banknote, which has been released from the gap between the release roller 54 and the opposite roller 56, from getting out from the reject unit 50 to the outside of the casing 92. Further, the stopper 52 can be rotated by hand. By rotating the stopper 52 by hand in a clockwise direction in FIG. 2, the operator can optionally take out the banknotes stored in the reject unit 50.

In this embodiment, each banknote can be released into the reject unit 50 from the gap between the release roller 54 and the opposite roller 56, with the direction in which the banknote is released kept in a substantially horizontal direction, i.e., in a direction substantially the same as the transport direction of the banknote transported by the lower transport mechanism 24 in a position just before the release roller 54.

Next, the sensor system of the banknote handling machine 1 will be described. As shown in FIG. 2, a sensor 70 for detecting whether or not the banknotes are placed on the hopper 11 is provided to the banknote feeding unit 10. Further, another sensor 71 is provided to an inlet of the upper transport mechanism 22 in the transport unit 20. This sensor 71 can serve to detect that the respective banknotes are securely taken in the casing 92. Still another sensor 72 is composed of a transparent sensor constituting a part of the recognition unit 28. This sensor 72 can serve to detect the denomination, authenticity or the like of each banknote, based on the light transmittance.

Sensors 73, 74, 75 are arranged in series along the lower transport mechanism 24 in the transport unit 20, respectively, while the diverters 60, 62 are located between the sensors 73, 74 and between the sensors 74, 75, respectively. The sensor 73 is located on the upstream side relative to the diverter 60 and serves to detect all of the banknotes transported by the lower transport mechanism 24. Meanwhile, the sensor 74 is located on the downstream side relative to the diverter 60 and serves to detect only the banknotes that are not diverted by the diverter 60, from among the banknotes transported by the lower transport mechanism 24. The sensor 75 is located on the downstream side relative to the diverter 62, and serves to detect only the banknotes that are not diverted by the diverter 62, from among the banknotes transported by the lower transport mechanism 24.

Furthermore, sensors 76, 77 are provided to the diversion lines 34, 44, respectively. These sensors 76, 77 can serve to detect the banknotes respectively diverted from the lower transport mechanism 24 and fed to the diversion lines 34, 44, respectively.

Additionally, sensors 78, 79 are provided to middle parts of the first and second stacking units 30, 40, respectively. These sensors 78, 79 can serve to detect that the banknotes are stacked in each stacking unit 30, 40, in an abnormal state, such as a standing state or the like, respectively. Furthermore, sensors 80, 81 are provided to lower parts of the first and second stacking units 30, 40, respectively. These sensors 80, 81 can serve to detect whether or not the banknotes are stored in the stacking units 30, 40, respectively. In addition, a sensor 82 is provided to the reject unit 50. This sensor 82 can serve to detect whether or not the banknotes are stored in the reject unit 50.

Each of the above sensors 70 to 82 is connected with the control unit 90, so that detection results of these sensors 70 to 82 can be transmitted to the control unit 90, respectively.

The control unit 90 can serve to control the banknote feeding unit 10, respective transport mechanisms 22, 24, 26 of the transport unit 20, respective diverters 60, 62 and the like, based on the detection result on each banknote detected by the respective sensors 70 to 82 as well as on each recognition result thereon obtained from the recognition unit 28. More specifically, the control unit 90 can control each diverter 60, 62 to divert the banknotes judged to be the normal ones from the lower transport mechanism 24 and then feed them to either one of the stacking units 30, 40, based on each recognition result on the banknotes obtained from the recognition unit 28. It is noted that the operation of this control unit 90 will be detailed later.

Now, the operation of the banknote handling machine 1 as constructed above will be discussed.

First, the plurality of banknotes are placed on the hopper in the stacked condition by the operator. Then, the banknotes stored in the hopper 11 are fed into the casing 92 of the banknote handling machine 1, one by one, by the banknote feeding unit 10. Thereafter, the banknotes taken in the casing 92 are transported by the transport unit 20. Specifically, the banknotes respectively taken in the casing 92 are transported, by the upper transport mechanism 22, intermediate transport mechanism 26 and lower transport mechanism 24, in this order.

While the banknotes are transported by the transport unit 22, each banknote is detected by the recognition unit 28 about the fitness, authenticity, denomination, orientation, face/back, transported condition and the like thereof. In this case, the banknotes that cannot be recognized by the recognition unit 28 (e.g., the damaged unfit banknotes or the like) and/or banknotes that have been excluded from the banknotes to be stored in each stacking unit 30, 40, because of their abnormal transported condition (e.g., the obliquely transported condition or the like), even after they have been recognized, are judged to be the "rejected banknotes" to be fed to the reject unit 50, respectively. Meanwhile, the banknotes that have satisfied predetermined conditions and thus been judged to be the normal banknotes by the recognition unit 28 are recognized as the banknotes to be stored in either one of the stacking units 30, 40, respectively.

Thereafter, the banknotes are fed to the lower transport mechanism 24 from the upper transport mechanism 22 via the intermediate transport mechanism 26. From among the banknotes transported by the lower transport mechanism 24, a portion of the banknotes will be diverted from the lower transport mechanism 24 and fed to each of the stacking units 30, 40, by the diverters 60, 62, respectively. Now, the operation of each diverter 60, 62 provided to the lower transport mechanism 24 will be detailed, with reference to FIGS. 3 through 5. As described above, the operation of each of the lower transport mechanism 24 and diverters 60, 62 is controlled by the control unit 90.

Figure 3:
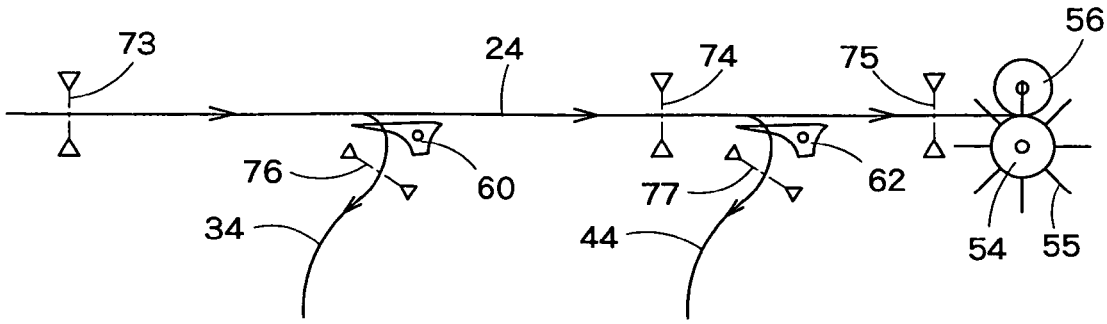
FIG. 3 is a diagram for illustrating the construction and operation of each diverter of the banknote handling machine shown in FIG. 2.

Namely, before the banknotes stored in the hopper 11 are fed in the casing 92 by the banknote feeding unit 10, as shown in FIG. 3, each diverter 60, 62 is in a position not allowing any banknote to be diverted from the lower transport mechanism 24 toward each diversion line 34, 44.

Figure 4:
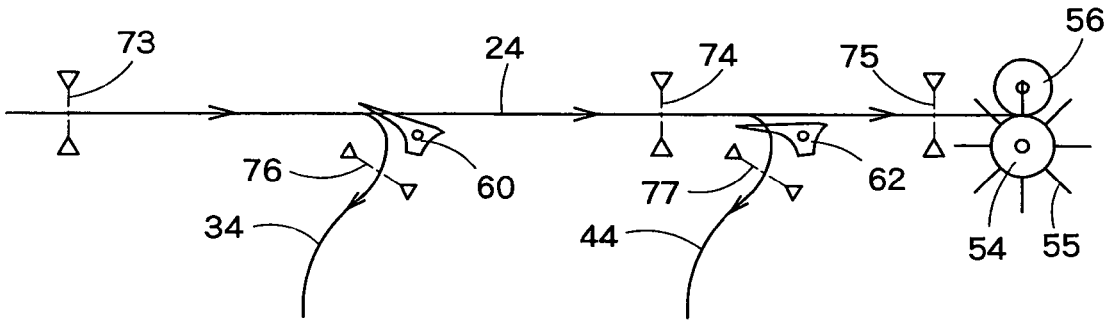
FIG. 4 is another diagram for illustrating the construction and operation of each diverter of the banknote handling machine shown in FIG. 2.

Thereafter, the banknotes stored in the hopper 11 are taken into the casing 92 and then recognized by the recognition unit 28. For instance, if the recognition unit 28 is set with a pattern for recognizing the denomination and/or fitness of Japanese banknotes, when the recognition result of the recognition unit 28 shows "normal thousand-yen banknote", the diverter 60 is driven as depicted in FIG. 4, in accordance with the detection result of the sensor 73 on this banknote. As a result, such banknote having been transported along the lower transport mechanism 24 is diverted from the lower transport mechanism 24 and fed to the diversion line 34. Then, the banknote fed to the diversion line 34 is stored in the first stacking unit 30. Thereafter, if the normal thousand-yen banknote is continuously taken in the casing 92, the respective diverters 60, 62 will be kept in positions as shown in FIG. 4.

Figure 5:
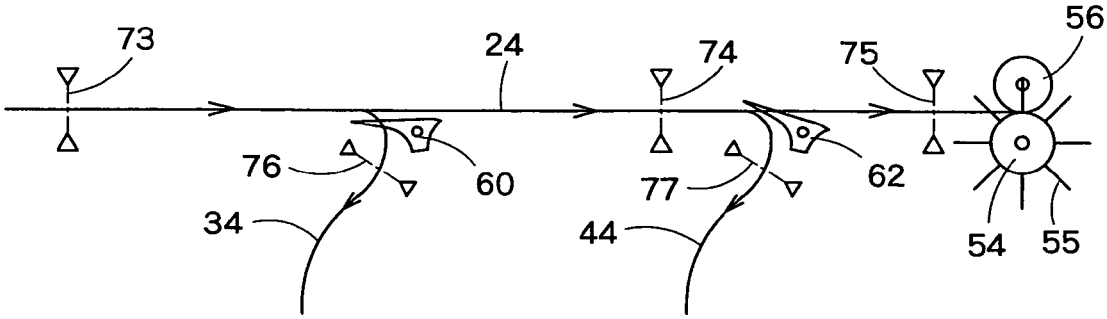
FIG. 5 is still another diagram for illustrating the construction and operation of each diverter of the banknote handling machine shown in FIG. 2.

Meanwhile, if the recognition result of the recognition unit 28 on the banknote taken in the casing 92 shows, for example, "normal ten-thousand-yen banknote", the diverter 62 is driven as depicted in FIG. 5, in accordance with the detection result of the sensor 73 on this banknote. As a result, such banknote having been transported along the lower transport mechanism 24 is diverted from the transport mechanism 24 and fed to the diversion line 44. During this operation, the diverter 60 is kept in the position not allowing the banknote to be diverted from the lower transport mechanism 24. In this way, the banknote fed to the diversion line 44 is stored in the second stacking unit 40. Thereafter, if the normal ten-thousand-yen banknote is continuously taken in the casing 92, the respective diverters 60, 62 will be kept in the positions as shown in FIG. 5.

However, in the case in which the respective diverters 60, 62 are in the positions as depicted in FIG. 4 or FIG. 5, if the recognition result of the recognition unit 28 on the banknote transported by the upper transport mechanism 22 shows some "rejected banknote," (more specifically, the banknote that cannot be recognized by the recognition unit 28 (e.g., the damaged unfit banknote or the like) or banknote that has been excluded from the banknotes to be stored in each stacking unit 30, 40, because of its abnormal transported condition (e.g., the obliquely transported condition or the like), even after it has been recognized, or otherwise if a two-thousand-yen banknote or five-thousand-yen banknote is recognized by the recognition unit 28), the respective diverters 60, 62 take the positions as depicted in FIG. 3, allowing such a banknote to be directly fed to the reject unit 50.

Then, based on the detection result of each sensor 75, 76, 77, 80, 81, 82 or the like, the control unit 90 judges that the banknotes transported by the lower transport mechanism 24 have been respectively fed to any of the stacking units 30, 40 and reject unit 50.

As described above, according to the banknote handling machine 1 of the above embodiment, at least two stacking units 30, 40, each adapted for stacking therein the banknotes taken in the casing 92 by the banknote feeding unit 10, are provided in the casing 92. In addition, the banknotes judged to be stored in the stacking units 30, 40 (e.g., the banknotes judged to be the normal banknotes), from among the banknotes transported by the transport unit 20, can be diverted from the transport unit 20 and selectively fed into the stacking units 30, 40, by the diverters 60, 62, respectively.

Thus, the banknotes judged to be removed from the casing 92 by the recognition unit 28 (i.e., the rejected banknotes), such as the banknotes that cannot be recognized by the recognition unit 28 (e.g., the damaged unfit banknotes or the like) and/or banknotes that have been excluded from the banknotes to be stored in each stacking unit 30, 40, because of their abnormal transported condition, even after they have been sufficiently recognized, from among the banknotes taken in the casing 92 by the banknote feeding unit 10, will be transported by the transport unit 20, without being diverted from the transport unit 20 by the diverters 60, 62, and thus fed to the reject unit 50, respectively. Therefore, each rejected banknote can be fed to the reject unit 50, without being excessively curved in the vicinity of each diverter 60, 62. Accordingly, the occurrence of the jam of the banknotes, upon transporting the rejected banknotes from the transport unit 20 to the reject unit 50, can be successfully avoided, thereby significantly enhancing the throughput of the banknote handling machine 1.

Besides, each banknote can be released toward the reject unit 50 from the lower transport mechanism 24, in substantially the same direction as the transport direction of the banknote which is transported on the lower transport mechanism 24, immediately before it is fed out toward the reject unit 50. Thus, rejected banknotes can be released from the lower transport mechanism 24 toward the reject unit 50, without being curved. Therefore, the occurrence of the jam of the banknotes can be prevented, more effectively, upon transporting each rejected banknote from the lower transport mechanism 24 to the reject unit 50

In this embodiment, the transport unit 20 is composed of the upper transport mechanism 22, lower transport mechanism 24 provided below the upper transport mechanism 22 and intermediate transport mechanism 26 provided between the upper transport mechanism 22 and the lower transport mechanism 24, while both of the upper transport mechanism 22 and lower transport mechanism 24 extend in the substantially horizontal direction, respectively. Thus, each banknote can be transported in the substantially horizontal direction, both by the upper transport mechanism 22 and by the lower transport mechanism 24, without being unduly curved. Therefore, the occurrence of the jam of the banknotes, especially the occurrence of the jam caused by the rejected banknotes, on the transport unit 20 can be prevented more securely. Further, the transport operation of this embodiment, for transporting each banknote from an upper position to a lower position, i.e., from the upper transport mechanism 22 to the lower transport mechanism 24, can successfully avoid transportation of the banknotes in a direction against gravity.

Furthermore, since the reject unit 50 is located below the banknote feeding unit 10, as shown in FIG. 2, each banknote can be transported from the upper position to the lower position, thereby preventing the banknote from being transported in the direction against gravity. This can eliminate a need for always gripping (or grasping) each banknote, such as by using proper transport belts or the like, during the transport operation, unlike the case requiring to transport the banknote from the lower position to the upper position. Therefore, the occurrence of the jam in the transport unit 20 can be further prevented. Additionally, in the case in which the rejected banknotes fed into the reject unit 50 are required to be recognized again by the recognition unit 28, the position of the banknote feeding unit 10 located above the reject unit 50 can facilitate the re-set of the rejected banknotes into the banknote feeding unit 10.

It should be noted that the banknote handling machine 1 of this invention is not limited to the aspect as described above, and various modifications or variations can be made thereto.

For instance, the number of the stacking units provided in the banknote handling machine 1 is not limited to two, but may be three or more. In this case, it is preferred to provide a number of diverters and diversion lines corresponding to the respective stacking units.

In addition to the control operation as described above, the control unit 90 may further control the diverters 60, 62 and transport unit 20, as described below.

As one example of such variations of the operation of the control unit 90, the control unit 90 may control the transport unit 20 and diverters 60, 62 to feed each banknote present on the transport unit 20 to the reject unit 50, when the banknote that has been judged to be one to be stored in each stacking unit 30, 40 (e.g., the banknote judged to be the normal one) by the recognition unit 28 can no longer be fed to the stacking unit 30 or 40.

For instance, the banknotes, each judged to be the normal banknote by the recognition unit 28, may be jammed at, for example, an inlet of each diversion line 34, 44, each stacking unit 30, 40 or the like, after being diverted from the transport unit 20 by each diverter 60, 62. Otherwise, the banknotes may get delayed on the transport unit 20. In such cases, the banknotes once taken in the casing 92 can no longer be fed to each stacking unit 30, 40. However, the control unit 90 can drive the transport unit 20 and diverters 60, 62 to feed the banknotes remaining on the transport unit 20 to the reject unit 50. This can eliminate the need to open the casing 92 of the banknote handling machine 1 and remove, by hand, the banknotes remaining on the transport unit 20, thus saving the time for recovering the banknote handling machine 1.

As another example of the variations of the operation of the control unit 90, the control unit 90 may control the transport unit 20 and diverters 60, 62 to feed the banknotes present on the transport unit 20 to the reject unit 50, when some stoppage of the banknotes on the transport unit 20 is detected by any of the sensors 71 to 77 and the like.

For instance, such stoppage of the banknotes on the transport unit 20 may be caused by the jam of the banknotes on the transport unit 20, and therefore these banknotes can no longer be fed to each stacking unit 30, 40. However, even in such a case, in order to remove the jam on the transport unit 20, the control unit 90 can control the transport unit 20 and diverters 60, 62 to feed the banknotes remaining on the transport unit 20 to the reject unit 50. Therefore, there is no need to open the casing 92 of the banknote handling machine 1 and remove, by hand, the jammed banknotes. Thus, the time required for recovering the banknote handling machine 1 can be significantly saved.

The invention claimed is:

1. A paper sheet handling machine, comprising:

a casing;

an operation unit on a front face of the casing;

a take-in unit having an opening in the side face of the casing and configured to take paper sheets, one by one, into the casing from the exterior;

a transport unit provided in the casing and configured to transport the paper sheets taken in by the take-in unit, successively, one by one, in the casing;

a recognition unit provided to the transport unit and configured to recognize each paper sheet transported by the transport unit;

at least two stacking units provided in the casing, each stacking unit being configured to stack therein the paper sheets taken in the casing by the take-in unit, each stacking unit being disposed laterally in juxtaposition and each stacking unit having an opening in the front face of the casing, through which opening paper sheets stacked in the stacking unit are removable by an operator;

a diverter provided to the transport unit on the downstream side of the recognition unit and configured to divert a portion of the paper sheets, from among the paper sheets transported by the transport unit, from the transport unit to feed the diverted paper sheets to each stacking unit;

a reject unit connected with the transport unit on the downstream side of the diverter and configured to receive the paper sheets that are not diverted from the transport unit by the diverter; and a control unit configured to control the diverter to divert the paper sheets respectively judged to be stored in each stacking unit, from the transport unit to feed the diverted paper sheets to each stacking unit, based on each recognition result on the paper sheets provided from the recognition unit, wherein the transport unit includes a first transport mechanism extending in a substantially horizontal direction, a second transport mechanism extending in the substantially horizontal direction below the first transport mechanism, and an intermediate transport mechanism provided between the first transport mechanism and the second transport mechanism;

wherein each paper sheet taken in the casing from the exterior by the take-in unit is transported by the first transport mechanism, intermediate transport mechanism and second transport mechanism, in this order;

wherein the transport unit has a substantially U-like shape;

wherein the diverter is located in the second transport mechanism;

wherein the reject unit is connected with a downstream end of the second transport mechanism;

wherein each of the first transport mechanism and the second transport mechanism is disposed to transport paper sheets in a direction parallel to the front face of the casing; and wherein the reject unit has an opening in the side face of the casing below the opening of the take-in unit through which opening of the reject unit paper sheets received by the reject unit are removable by an operator.

2. The paper sheet handling machine according to claim 1, wherein upon a feed operation of the paper sheets from the transport unit to the reject unit, each paper sheet can be released toward the reject unit from the transport unit, in substantially the same direction as the transport direction of the paper sheet transported by the transport unit immediately before being fed out to the reject unit.

3. The paper sheet handling machine according to claim 1, wherein the recognition unit is located in the first transport mechanism.

4. The paper sheet handling machine according to claim 1, wherein the reject unit is provided below the take-in unit.

5. The paper sheet handling machine according to claim 1, wherein the control unit can further control the transport unit and diverter to feed the paper sheets present on the transport unit to the reject unit, when the paper sheets, each judged to be stacked in each stacking unit by the recognition unit, can no longer be fed to the stacking unit.

6. The paper sheet handling machine according to claim 1, wherein a detection unit configured to detect each paper sheet transported by the transport unit is provided to the transport unit, and wherein the control unit can further control the transport unit and diverter to feed the paper sheets present on the transport unit to the reject unit, when the detector detects stoppage of the paper sheets on the transport unit.

* * * * *